United States Patent [19]

Hahn

[11] Patent Number: 4,587,763

[45] Date of Patent: May 13, 1986

[54] GRINDING MACHINE

[76] Inventor: Robert S. Hahn, 26 Rice Ave., Northboro, Mass. 01532

[21] Appl. No.: 744,132

[22] Filed: Jun. 12, 1985

Related U.S. Application Data

[63] Continuation of Ser. No. 467,394, Feb. 17, 1985, abandoned.

[51] Int. Cl.[4] ..... B24B 5/00

[52] U.S. Cl. ..... 51/5 D; 51/290; 51/322; 51/240 T; 51/356

[58] Field of Search ..... 51/5 D, 266, 165.73, 51/165.87, 165.75, 165.93, 356, 290, 322, 326, 240 T, 325, 73 R, 50 R, 216 T, 239; 248/DIG. 1

[56] References Cited

U.S. PATENT DOCUMENTS

| | | | |
|---|---|---|---|
| 810,903 | 1/1906 | Blechschmidt | 51/34 H |
| 2,507,437 | 5/1950 | Eserkaln | 51/266 |
| 2,982,062 | 5/1961 | Jackson | 51/327 |
| 3,372,322 | 10/1963 | Lockwood et al. . | |
| 3,601,931 | 1/1969 | Hahn . | |
| 3,634,978 | 6/1969 | Uhtenwoldt et al. . | |
| 3,739,528 | 5/1971 | Robillard et al. . | |
| 3,828,477 | 8/1974 | Sanford | 51/5 D |
| 3,842,543 | 4/1972 | Hohler et al. . | |
| 4,006,651 | 6/1975 | Anderson et al. . | |
| 4,068,412 | 11/1976 | Camp et al. . | |
| 4,170,851 | 9/1977 | Enos . | |
| 4,417,422 | 11/1983 | Redeker et al. | 51/50 R |

OTHER PUBLICATIONS

Mason "Design Features of Elb Surface and Profile Grinders" 4–1973 Machinery and Production Engineering.

*Primary Examiner*—Frederick R. Schmidt
*Assistant Examiner*—Robert A. Rose
*Attorney, Agent, or Firm*—Blodgett & Blodgett

[57] ABSTRACT

Grinding machine having a plurality of wheelheads for simultaneously grinding internal and external surfaces of revolution on a large workpiece, the machine including a temperature-controlled reference plate.

6 Claims, 3 Drawing Figures

GRINDING MACHINE

This invention was made with government support under contract F49620-82-C-0066 awarded by the Air Force Office of Scientific Research. The government has certain rights in this invention.

This is a continuation of co-pending application Ser. No. 467,394 filed on Feb. 17, 1985 now abandoned.

BACKGROUND OF THE INVENTION

In the art of metal finishing, a major problem exists in connection with large workpieces having a considerable number of different surfaces of revolution (both internal and external) that need to be finished. The conventional method of grinding these workpieces usually requires several set-ups on one or more grinding machines. Following each set-up the finishing of a given surface is carried out on each workpiece in the production lot. Upon completion, the grinding machine has to be reset to execute the next operation and all the workpieces have to be reloaded on the machine to finish another surface. Therefore, considerable time and cost can be saved if a number of operations can be performed for one staging of the workpiece. For that reason, it is desirable to grind a large number of these surfaces simultaneously and, for that purpose, an abrasive wheel that is capable of grinding more than one surface at the same time may be used. This is accomplished by using a formed wheel to grind several surfaces at one time. Unfortunately, in this type of arrangement, it is difficult to to maintain the necessary size and profile accuracy. For instance, it is currently necessary, as the final size is approached, to stop the machine to measure the size of the surfaces manually and to input into the control revised positions for terminating the grind cycle to achieve the correct size. This is complicated by the fact that several surfaces are being finished at the same time. The major source of difficulties with sizing (aside from the fact that it is impossible to provide in-process gaging on such machines) is the fact that a plurality of surfaces of large radius are involved. The fact that two wheelheads for internal and external surfaces must be provided on the large structure of the machine and widely separated (necessitated by the large diameter of the surfaces being finished) means that thermal errors are much larger than would otherwise be true. These and other difficulties experienced with the prior art devices have been obviated in a novel manner by the present invention.

It is, therefore, an outstanding object of the invention to provide a grinding machine for accurately grinding a multiplicity of surfaces simultaneously on a large workpiece.

Another object of this invention is the provision of a grinding machine for finishing a plurality of surfaces of revolution on a workpiece without in-process gaging and without attention from a human operator.

A further object of the present invention is the provision of a grinding machine having a reference plate with contact surfaces, which reference plate is maintained at a constant temperature to permit sizing stability.

With these and other objects in view, as will be apparent to those skilled in the art, the invention resides in the combination of parts set forth in the specification and covered by the claims appended hereto.

SUMMARY OF THE INVENTION

In general, the invention consists of a grinding machine having a base on which is mounted a rotatable table, carrying a workpiece having a surface of revolution to be finished. A wheelhead is mounted on the base and carries a rotatable abrasive wheel for finishing the surface of revolution. A dresser is mounted on the base for renewing the operative surface of the abrasive wheel. A reference plate is associated with the table and has a contact surface extending parallel to the axis of rotation of the table; means is provided for supplying constant temperature fluid around the reference plate to maintain its temperature at a uniform value and to minimize its expansion and contraction.

Specifically, the table rotates about a vertical axis where the workpiece has internal and external surface of revolution to be finished, both surfaces being held generally coaxial of the table axis and a separate wheelhead is mounted on the base for each surface. A separate dresser is mounted on the base for each wheelhead and the contact surface of the reference plate is a cylindrical surface which is coaxial of the table axis and is engageable by a contact element of each dresser, this contact surface of the reference plate being maintained at a fixed distance from the table axis of rotation.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
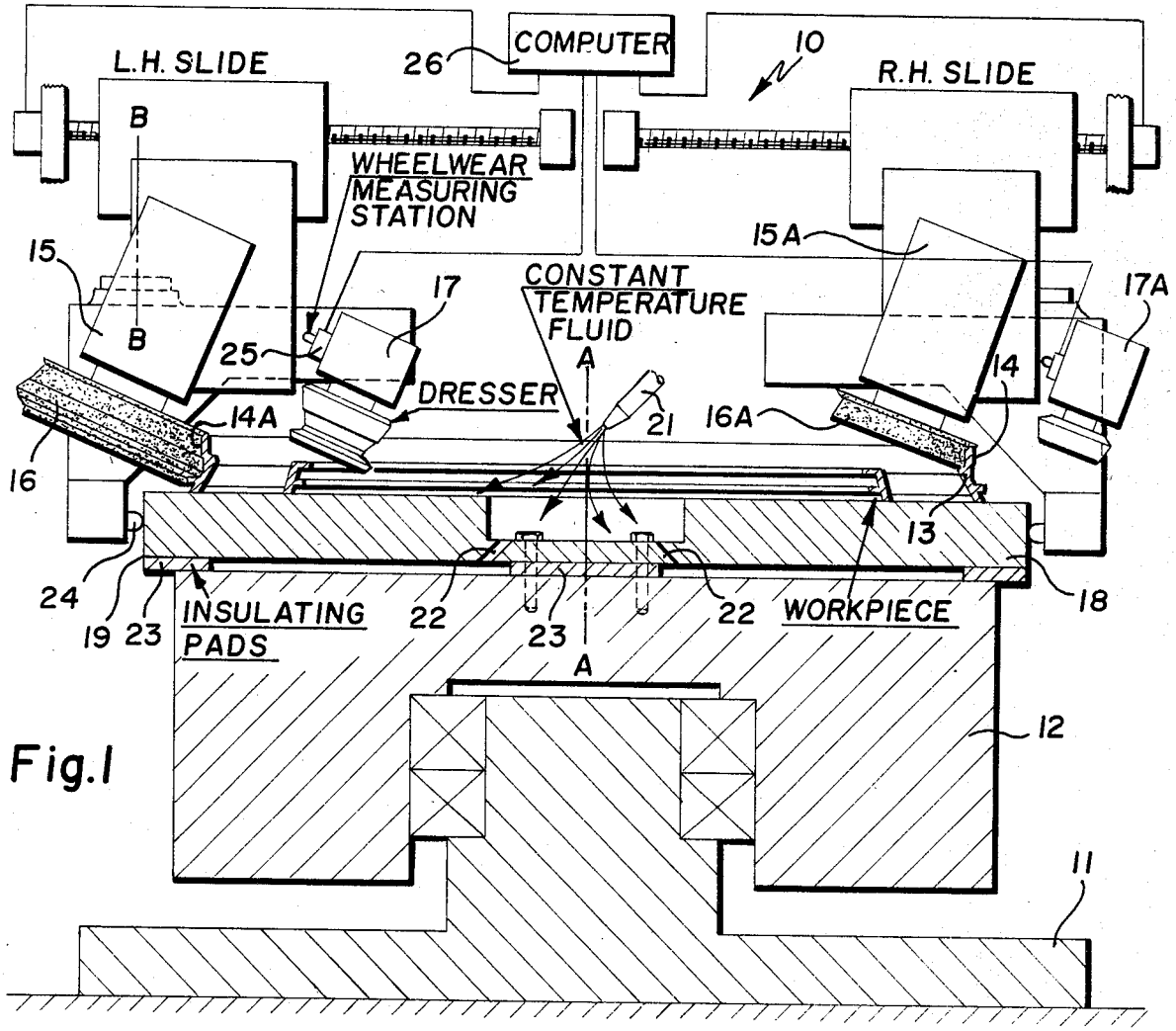
FIG. 1 is a somewhat schematic, vertical sectional view of a grinding machine incorporating the principles of the present invention.

Referring first to FIG. 1, which best shows the general features of the invention, it can be seen that the grinding machine, indicated generally by the reference numeral 10 is shown as having a base 11 on which is mounted a rotatable table 12 including a reference plate 18 for carrying a workpiece 13. The workpiece has a surface of revolution 14 to be finished by the abrasive process. A wheelhead 15 is mounted on a cross-slide and carries a rotatable abrasive wheel 16 for finishing the surface of revolution 14. A dresser 17 is mounted on the base for renewing the operative surface of the abrasive wheel 16. A reference plate 18 is associated with the table 12 and has a contact surface 19 extending parallel to the axis A—A of revolution of the table 12. Means, including a nozzle 21, is provided for supplying a constant temperature fluid to the reference plate 18 to maintain its temperature at a uniform value and to minimize expansion and contraction.

As is evident in the drawing, the fluid from the nozzle 21 flows through passages 22 in the body of the reference plate 18. Insulating pads 23 are provided that lie between the reference plate 18 and the rotatable table 12.

The dresser 17 is provided with a contact element 24 and the dresser is movable about an axis B—B to bring the contact element into engagement with the contact surface 19 of the reference plate 18 to locate the operative surface of the dresser. The dresser also has a wheelwear measuring station 25 for engagement on occasion with the operative surface of the abrasive wheel 16 to generate an indication of wheelwear.

Figure 2:
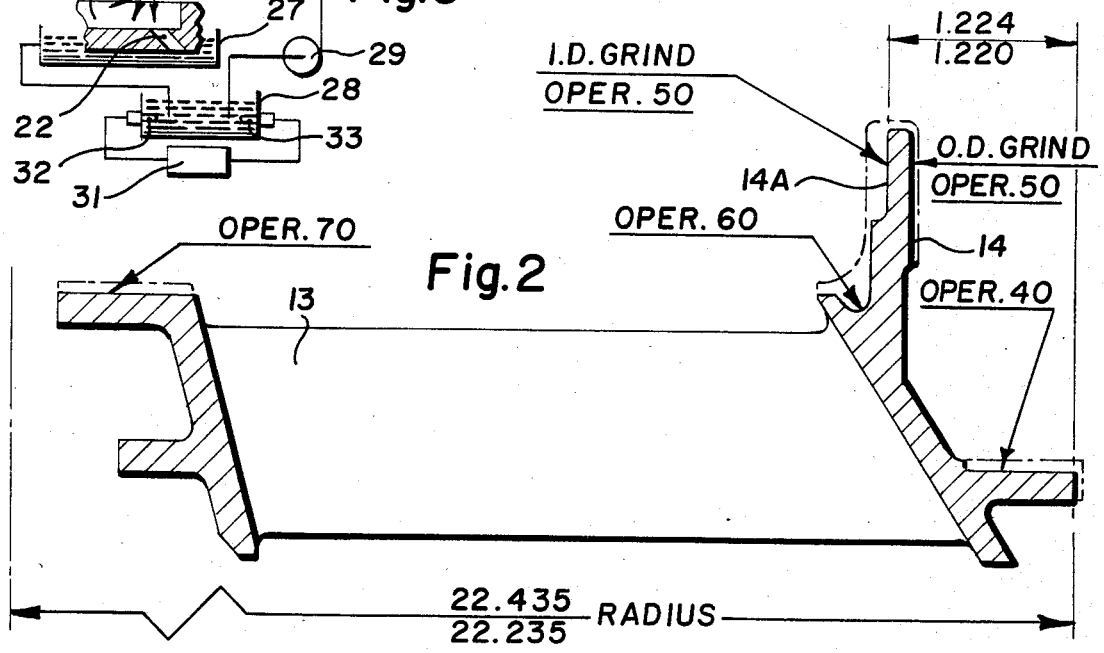
FIG. 2 is a cross-sectional view of a portion of a workpiece to be machined, particularly while on the inventive grinding machine.

The table rotates about the vertical axis A—A and referring to FIG. 2, it can be seen that the workpiece 13 has an external surface of revolution 14 and an internal surface of revolution 14A that are to be finished, both surfaces being located on the table in a generally coaxial relationship to the table axis A—A. A separate wheelhead 15 and 15A is mounted on a cross-slide for each of the surfaces 14 and 14A and a separate dresser 17 and 17A is associated with each wheelhead. The contact surface 19 of the reference plate 18 is a cylindrical surface of invariant diameter that is coaxial of the table axis A—A and is engageable by a contact element of each of the dressers 17 and 17A. In other words, the wheel 16 is carried on the wheelhead 15, is used to finish the external surface 14 of the workpiece 13, and can be dressed and located by means of the dresser 17. At the same time, the wheel 16A is used to finish the internal surfaces 14A, is mounted in a wheelhead 15A, and can be dressed and located by means of the dresser 17A. Both dressers locate themselves on the invariant reference surface 19 of the reference plate 18.

Referring to FIG. 2, it can be seen that the particular workpiece 13 that is used as an illustration is an aircraft engine element known as a vane-cluster assembly third stage. It consists of a plurality of segmental elements which, when brought together, form a large ring having suitable vanes incorporating in it. The external surface 14 needs an OD grind by operation 50 as well as a radial surface and OD surface Operation 40, both of which can be finished simultaneously. On the inside of the ring, the surface 14A has a number of facets, including the portion accomplished by Operation 50 as well as Operation 60 (Oper 70 cannot be done simultaneously with Oper 50, 60). Both of these can be accomplished simultaneously with suitable wheels. The machine is operated by a means of a computer 26 as shown and described in my patent application Ser. No. 419,319, filed Sept. 17, 1982.

Figure 3:
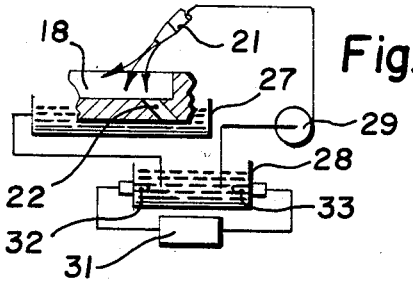
FIG. 3 is a schematic view of an apparatus for maintaining fluid at a constant temperature.

Referring next to FIG. 3, it can be seen that the fluid leaving the nozzle 21 flows through the passages 22 in the reference plate 18 and is caught in a tray 27, so that the reference plate lies in a substantial bath of the fluid. The fluid in the bath overflows into a sump 28 where it is collected. A pump 29 returns the fluid to the nozzle 21 for recirculation. A temperature signal from a thermometer 32 located in the sump is delivered to a control means 31 to operate a heating or cooling coil 31 (also located in the sump) to maintain the liquid at a constant temperature.

The operation and advantages of the present invention will now be readily understood in view of the above discussion. Large diameter workpieces often require finishing by means of wheelheads on separate slides. It may also be desirable to perform grinding operations on both heads and slides simultaneously. The aircraft engine Vane-Cluster Assembly-Third Stage workpiece shown in FIG. 2 is an example of an application where significant savings can be achieved by multi-operation grinding. The segmented savings are mounted on the table of the vertical grinding machine 10 to generate an O.D. of 44.67 inches along with the other surfaces shown in FIG. 2. FIG. 1 shows the configuration of such a typical large vertical grinding machine with the left hand head 15 arranged for O.D. grinding and a right hand head 15A for I.D. grinding. Current processing methods use the left hand head to grind operation 40 in one setup. In another setup, the O.D. of operation 50 is ground with the left hand head while the right hand head grinds the I.D. A third setup that is sometimes used has the left hand head roughing out part of the operation 60 and the right hand head finishing the groove of operation 60 to full depth. Operation 70 is performed in a fourth setup on a Browne & Sharp surface grinder.

With the computer-numerical-controlled (CNC) multi-operation that is part of the present invention, assuming that fixturing conditions can be satisfied, only one setup would be made. The left hand head would be setup to grind Operations 40 and OD grind operation 50 as shown in FIG. 2, thereby combining two operations into one. The I.D. part of Operation 50 and Operation 60 would also be combined and performed by the right hand head simultaneously with the OD operation. At the conclusion of the Operations (40, 50, 60) the right hand head would index into a position for executing Operation 70 by performing a Z feed. Currently as many as four setups are required to accomplish the grinding of these parts. The setup times for large grinders can vary from three hours to sixteen hours with eight hours as a reasonable average. Reducing the number of setups saves setup time. Not only is this accomplished, but it also reduces the cost of tooling, such as diamond dressing rolls. The prior art method of sizing the various surfaces on the workpieces of this type generally requires the operator to interrupt the operation to make a measurement of the stock and to enter this information into the control, which then proceeds to finish grind to final size. It would, of course, be desirable to have the machine automatically hold size directly without the attention of an operator, thereby approaching untended operation. With multi-operation grinding, it is impractical to use "in-process" gaging because of the many surfaces to be generated. Therefore, it is necessary for the machine and its control to provide automatic precision sizing. Size errors can be caused by (1) thermal expansion, (2) elastic deflection of the machine components, (3) variable amounts of wheelwear, and (4) inaccuracies of machine movements. The present invention involves a system for eliminating or greatly reducing the thermal expansion errors and the wheelwear errors.

In order to remove thermal expansion errors, the cross slides on the large vertical grinder 10 are typically driven by independent servo motors and ball screw drives, as illustrated. The origin of the X coordinate of each system is implicitly located at the corresponding ball-screw thrust bearings nearby. On large machines, only a few degrees rise in temperature can cause significant thermal expansion in the ball-screw columns and structure which result in size errors. The workpiece shown in FIG. 2 needs the tolerance of plus or minus 0.002 in between the I.D. grind of Operation 50 (right hand head) and the O.D. grind of Operation 50 (left hand head). This means that a common, stable, reference system is required to precisely coordinate the movements of both heads. The effect of thermal expansion and contraction in the machine structure and ball screws can largely be eliminated by using the dresser as a sizing reference and by ensuring that the dresser is stably located in relation to the workpiece or table centerline. In this way the wheel (once it is dressed)

must move a specified distance from the dresser to produce a precision size. Thermally-caused size errors are reduced to the thermal expansion of only that section of the ball screw that is involved in moving the short distance. Therefore, the dressers should be located as close as possible to the size positions. To construct a stable reference system, a constant temperature is required. The temperature-controlled coolant system which is illustrated in FIG. 3 is the most convenient constant temperature reference. The diamond roll dresser is mounted on a trunnion permitting it to be swung in over the workpiece, thus positioning the dresser roll relative to the work centerline. The contact element 24 locates on the constant temperature reference plate surface 19 which is bolted to the rotary table 12 at the center through the insulating pads 23. The constant temperature cutting fluid bathes both the top and bottom surfaces of the reference plate, thus maintaining it at constant temperature. The rotary table 12 is free to expand under the insulating pads due to bearing and table drive heat without deforming the reference plate. The grinding wheel comes into position in front of the trunnion and dresser bracket and may move alternately back and forth from its grinding position to its dressing position. In some cases, it may be desirable to replace the contact element 24 with a non-contacting displacement transducer and provide a fixed stop against the base to avoid the sliding contact top. Then, the displacement transducer can be interfaced with the computer 26 which, in turn, can compensate for thermal dresser movements relative to the reference plate. A similar diamond dress roll and trunnion support provided for the right hand head references to the common reference plate. In this way, thermal size errors can be largely eliminated. Thermal displacement in other parts of the machine will have no affect on size, as long as the wheels contact the dresser rolls during dressing. In effect, the thermal displacements are absorbed in the "compensation for wheelwear" movement when it takes place.

Success of the grinding operation described above is critically dependent upon the grinding wheels ability to remove stock and to maintain its form. It is important, therefore, to develop a relationship between stock-removal rate and wheelwear rate. After the wheel has been dressed, a selected surface of the wheel is positioned by the computer 26 against the wheelwear measuring station 25 and the sensing switch mounted therein. When this switch makes contact, the wheel position is saved in memory. The wheel then goes to its grinding position. After grinding for a known time under a certain force derived from a load cell reading, the computer repositions the wheel at the wheelwear measuring station 25 and feeds it against the switch until contact is made again. The difference in positions gives the actual wheelwear and this permits the computer to determine a wheelwear parameter which it uses to eliminate size errors due to variable wheelwear.

The elimination of thermal expansion sizing errors can be achieved by either locating the dresser at an invariant distance from the work centerline or by monitoring the distance and compensating for variations in dresser location by the computer to provide drift-free sizing.

The method proposed in this application for referencing two independent cross slides to a common isothermal reference relating to the work centerline serves as an excellent approach to holding size automatically on large grinding machine. The computerized acquisition of wheelwear data by the introduction of a wheelwear measurement station 25 and the use of this data to estimate and compensate for wheelwear during grinding operation is also a useful feature.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having thus been described, what is claimed as new and desired to secure by Letters Patent is:

1. Grinding machine, comprising:

(a) a base on which is mounted a rotatable table for carrying a workpiece having a surface of revolution to be finished, (b) a wheelhead mounted on the base and carrying a rotatable abrasive wheel for finishing the surface of revolution, (c) a dresser mounted on the base for receiving the operative surface of the abrasive wheel;

(d) a reference plate mounted on the table but thermally isolated therefrom by means of insulating pads extending between the reference plate and the table, the plate having a cylindrical contact surface which is coaxial with the axis of rotation of the table, and (e) means mounted at the base supplying constant temperature fluid through passages in the reference plate to maintain its temperature at a uniform value and to minimize expansion and contraction.

2. Grinding machine as recited in claim 1, wherein the dresser is provided with a contact element and is movable to bring the contact element into engagement with the contact surface of the reference plate to locate the operative surface of the dresser.

3. Grinding machine as recited in claim 2, wherein the dresser has a wheelwear measuring station for engagement on occasion with the operative surface of the abrasive wheel to generate an indication of wheelwear.

4. Grinding machine as recited in claim 1, wherein the table rotates about a vertical axis, wherein the workpiece has internal and external surfaces of revolution to be finished, both surfaces being held generally coaxial of the table axis, wherein a separate wheelhead is mounted on the base for each surface, wherein a separate dresser is mounted on the base for each wheelhead, and wherein the contact surface of the reference plate is engageable by a contact element of each dresser.

5. Grinding machine as recited in claim 4, wherein each abrasive wheel has an operative surface configuration that is capable of plunge grinding a plurality surfaces of revolution during a single grinding operation.

6. Grinding machine as recited in claim 1, wherein the wheelhead is under the control of a computer.

* * * * *